United States Patent [19]

Scherbakov et al.

[11] 4,008,011

[45] Feb. 15, 1977

[54] PISTON COMPRESSOR

[76] Inventors: Vsevolod Sergeevich Scherbakov, Konkovo-Derevlevo, korpus 7"v", kv. 120; Igor Andreevich Gruzintsev, Malaya Schukinskaya ulitsa, 5, korpus 2, kv. 14; Viktor Mikhailovich Zolotukhin, Raduzhnaya ulitsa, 10, kv. 17, all of Moscow, U.S.S.R.

[22] Filed: Feb. 20, 1975

[21] Appl. No.: 551,413

[52] U.S. Cl. ..... 417/446; 417/505

[51] Int. Cl.[2] ..... F04B 7/00

[58] Field of Search ..... 417/446, 505

[56] References Cited

UNITED STATES PATENTS

| | | | |
|---|---|---|---|
| 2,681,177 | 6/1954 | Hartwell | 417/446 |
| 2,831,625 | 4/1958 | Hartwell et al. | 417/446 |
| 3,351,271 | 11/1967 | Bellmer | 417/446 |
| 3,829,255 | 8/1974 | Bykov et al. | 417/505 |

*Primary Examiner*—Carlton R. Croyle
*Assistant Examiner*—G. P. LaPointe
*Attorney, Agent, or Firm*—J. Harold Nissen

[57] ABSTRACT

A piston compressor, in which an electromagnet coil is mounted on the outer side of the cylinder block cover and is used to actuate the suction valves of the cylinder block. The electromagnet coil is connected to each suction valve of the cylinder block through a magnetic circuit. The magnetic circuit is formed by the cylinder block cover, by the cylinder block body and by the pressure valve of each cylinder. The cylinder block cover and the cylinder block body are interlaid with a gasket made of nonmagnetic material.

1 Claim, 2 Drawing Figures

PISTON COMPRESSOR

BACKGROUND OF THE INVENTION

The present invention relates to piston compressors.

The invention can most advantageously be realized in refrigerator piston compressors operating on various refrigerants, including aggressive and explosive agents, such as freon, ammonia, propane, etc., and in compressors wherein the displacement is controlled through disconnection of several cylinders at a time, and, particularly, through disconnection of cylinders in pairs.

These are already known in the art compressors incorporating capacity regulators, wherein the displacement is controlled by lifting the suction valves in several cylinders simultaneously by the use of a hydraulic or a pneumatic drive.

Thus, the GRAT company of Denmark builds piston compressors for refrigeration units, wherein the displacement is controlled by a regulator incorporating movable spring-loaded bushings mounted on the outer surfaces of the cylinder sleeves. Lifters built into the top section of the movable bushings act upon the suction valve ring disks.

The movable bushings are mechanically linked in pairs with horizontal rods bearing the loads due to the force exerted by a lifting spring and the oil pressure built up in the distribution unit. The spring and the unit are arranged on the compressor body between the cylinders.

With no oil pressure produced in the distribution unit by the compressor oil pump, the lifting spring displaces the horizontal rods to the upper position, and the rods in turn drive the movable bushings and the lifters, with the result that the disks in the suction valves of both cylinders are lifted. Thus, the compressor operates at a lighter duty due to bypassing of the gas from two cylinders simultaneously into the compressor suction chamber.

When an oil pressure is applied to the distribution unit, the force exerted by the lifting spring is balanced by the oil pressure. The movable bushings and the lifters acted upon by their own springs are caused to move downward, and both cylinders start operating.

The method whereby the piston compressors employ hydraulic or pneumatic lifting of the suction valve disks in groups (in particular, in pairs) for changing the compressor capacity permits simplification of the displacement regulation system and of the compressor as a whole.

However, the compressors incorporating the above-mentioned units have a number of disadvantages. It is a known fact that the response of the hydraulic drives is rather slow and that the use of mechanical lifters actuating the suction valve disks is detrimental to the reliability both of the capacity regulation unit and to the suction valve disks which fail quite frequently.

In addition, the use of the hydraulic drives in the piston compressor capacity regulation systems necessitates an increase in the power of the compressor oil pumps to produce a pressure sufficient for lifting the disks, and further development of special-purpose instruments and mechanisms to control the capacity regulation units.

Apart from whose compressors, the displacement is regulated by the units through hydraulic or pneumatic lifting of the suction valve disks, there are known compressors furnished with regulation units incorporating electromagnetic drives.

Thus, there is known in the art a piston compressor in which the capacity regulation unit comprises one or two electromagnet coils used to actuate one or two suction valve disks. The electromagnet coils are located either in the refrigerant medium, or are isolated from it by a coil casing and a screen made of nonmagnetic material. The travel of the suction valve disks is restricted by the disk travel limit stops which at the same time function as electromagnet poles. With an operating voltage applied to the coil winding, a magnetic field is produced, which is closed through a magnetic circuit passing through the suction valve disks, and thereby, causes the disks to thrust against the disk travel limit stops. The gas contained in the cylinder is bypassed to the suction chamber through the open suction ports.

Thus, there is known a prior-art piston compressor, whose capacity regulation unit comprises one or two electromagnet coils used to actuate one or two suction valve disks. The electromagnet coils are mounted either in the refrigerant medium, or are isolated from it by a coil casing and a screen made of nonmagnetic material. The travel of the suction valve disks is restricted by the disk travel limit stops which at the same time function as the electromagnet poles. With an operating voltage applied to the coil winding, a magnetic field is produced, which is closed through a magnetic circuit passing through the suction valve disks, and thereby, causes the disk to thrust against the disk travel limit stops. The gas contained in the cylinder is bypassed to the suction chamber through the open suction ports.

Compared to the piston compressors wherein the hydraulic or pneumatic drives are used to control the displacement, the piston compressors with the foregoing electromagnetic regulation units are distinguished by practically instantaneous response and by freedom from auxiliary intermediate components (such as the lifters) serving to actuate the valve disks. However, the piston compressors furnished with electromagnetic capacity regulators also suffer from a number of disadvantages.

In particular, tightness of the electromagnet coil in the capacity regulators of said compressors cannot be guaranteed, hence, the regulator cannot be used where explosive and corrosive agents are employed. Location of current-carrying lines inside the compressor and the use of electrode seals add to the impracticability of said regulators when aggressive and explosive agents are handled, and the compressor construction is fairly complicated. To replace a coil in case of failure, the compressor must be stopped, unsealed and subjected to partial disassembly.

The attempts to eliminate the above disadvantages have led to development of a new piston compressor, whose the capacity regulator comprises an electromagnet coil which actuates the suction valve. The coil is arranged on the outer side of the compressor body, and is connected to the suction valve by a magnetic circuit. The magnetic circuit is formed by the compressor body, by the cylinder and by the pressure valve body.

The attempts to eliminate the above disadvantages have led to development of a new compressor, whose capacity regulator comprises an electromagnet coil which actuates the suction valve. The coil is mounted on the outer side of the compressor body, and is connected to the suction valve by a magnetic circuit. The magnetic circuit is formed by the compressor body, by the cylinder and by the pressure valve body.

The suction valve is retained in the open position by force, and, hence, the cylinder is allowed to discharge when the supply voltage is applied to the electromagnet coil. The magnetic flux directed through the magnetic circuit is closed via the body of the suction valve. The resulting magnetic force lifts the disk of the suction valve.

A piston compressor incorporating said regulator provides for absolute tightness of the coil winding so that the compressor can be operated with explosive and aggressive agents, no stoppages and unsealing are required for replacement of the electromagnet coils, and the construction is simplified by utilizing the compressor parts and assemblies for completion of the magnetic circuit.

Yet, in the piston compressor provided with the prior-art capacity regulation unit, and also in the compressor provided with the regulator proposed by the German patent No. 636470, each compressor cylinder discharges through the use of an individual electromagnet coil, whereby simultaneous actuation of several suction valves of different compressor cylinders is not possible.

As a consequence, the compressor construction is complicated, plenty of wire is required, and the compressor dimensions and weight increase.

It is an object of the present invention to simplify the construction of the piston compressor by modifying the compressor capacity regulator capable of changing the compressor displacement by operating a group of cylinders actuated by a single electromagnet coil.

Another object of this invention is to reduce the weight of the piston compressor by virtue of reduced dimensions and reduced weight of the capacity regulator.

SUMMARY OF THE INVENTION

With these and other objects in view, the cylinder block of the present invention is provided with a piston compressor capacity regulator in the form of an electromagnet coil installed on the outer side of the cylinder block cover and used to actuate the suction valve of the cylinder in the cylinder block by means of a magnetic circuit which is connected, according to the invention, to each suction valve of the cylinder in the cylinder block, and is formed by the cylinder block cover, cylinder block body and suction valve of each cylinder in the cylinder block, with the cylinder block cover and cylinder block body separated by a gasket made of nonmagnetic material.

The piston compressor with an electromagnetic capacity regulator in accordance with the present invention provides for simultaneous actuation of several valves of different cylinders in one cylinder block effected by means of a single electromagnet coil with the result that the compressor construction is simplified because the number of electromagnet coils is reduced at least by half, the power supply system is simplified, and so is the shape of the magnetic circuit. As a consequence, both dimensions and weight of the compressor are reduced.

According to the present invention, several suction valves of the compressor cylinder block are simultaneously actuated by a single electromagnet coil. The magnetic flux passes through all the disks of the cylinder block suction valves. To prevent shorting of the magnetic flux outside the valve disks, a gasket made of nonmagnetic material is laid between the cylinder block cover and the compressor body.

In this case, the electromagnet coil magnetizing force rises, the magnetic flux dispersion drops, the loss in the magnetic field at the joints of the compressor parts decreases, and the constructional features are improved, so that the manufacturing process can be simplified.

These and other features and advantages of this invention will be best understood from the following description of an embodiment of the invention taken in conjunction with the accompanying drawings.

These and other features and advantages of this invention will become apparent from the following description of an embodiment of the invention taken in conjunction with the accompanying drawings.

DESCRIPTION OF THE PREFERRED EMBODIMENTS

Figure 1:
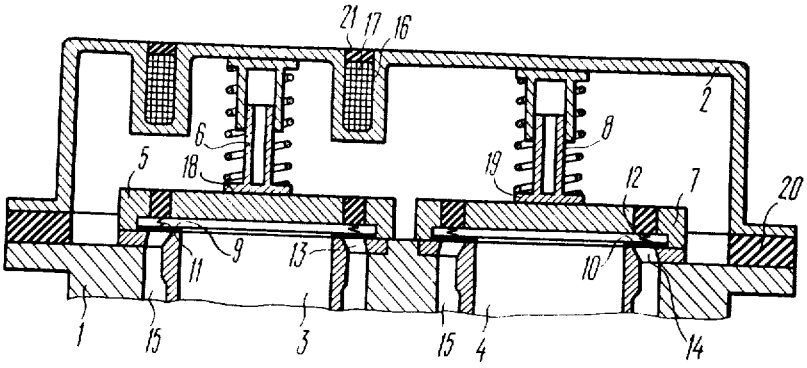
FIG. 1 shows schematically a section of the piston compressor incorporating a capacity regulator in accordance with the present invention.

Referring now to FIG. 1, the piston compressor comprises a cylinder block 1 with a cylinder block cover 2, and a regulator serving to control the displacement of said compressor. Arranged inside the cylinder block are cylinders 3 and 4. The cylinder 3 incorporates a suction valve 5 and a pressure valve 6. The cylinder 4 incorporates a suction valve 7 and a pressure valve 8. The suction valves 5 and 7 or the casing of the device limiting the rise of the suction valve disc comprise ring disks 9 and 10, respectively. Retracting springs 11 and 12 are installed on the top of the ring disks 9 and 10 of the suction valves 5 and 7.

The ring disk 9 shuts admission ports 13, and the ring disk 10 shuts admission ports 14. The admission ports 13 and 14 communicate with a suction chamber 15 of the compressor. The cover 2 of the cylinder block 1 carries an annular groove 16 on the outer side.

The annular groove 16 serves to install components of the compressor capacity regulator in the form of an electromagnet coil 17 connected to each suction valve 5 and 7 through a magnetic circuit.

The magnetic circuit is formed by the cylinder block cover 2, by the body of the cylinder block 1, and by the bodies of the pressure valves 6 and 8.

In order to produce a directed magnetic flux, the cover 2 of the cylinder block 1 is separated from the body of the cylinder block 1 by means of a gasket 20 made of nonmagnetic material. The coil 17 is closed with a cover 21 also made of nonmagnetic material.

According to the present invention, a rise is obtained in the magnetic force exerted by the electromagnet coil 17, and the dispersion of the magnetic flux is minimized.

The piston compressor operates as follows.

Figure 2:
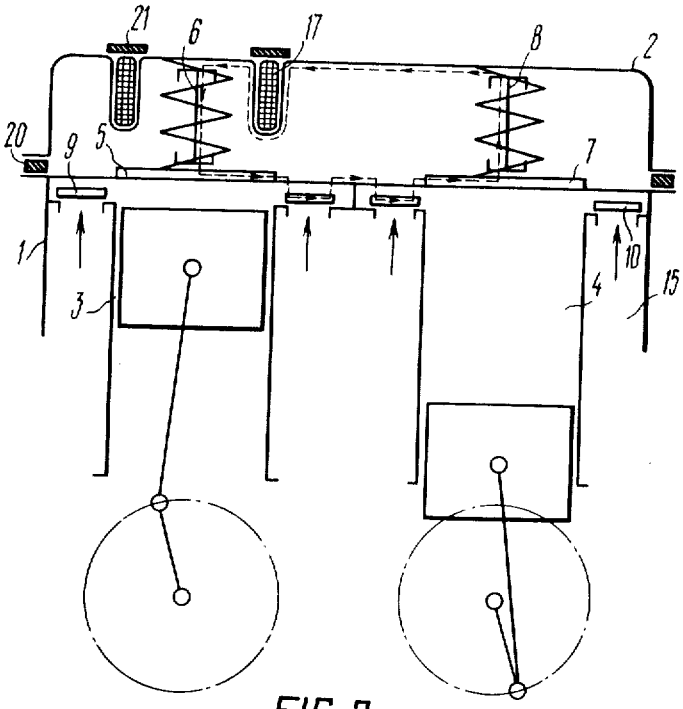
FIG. 2 is a functional diagram of the piston compressor incorporating the capacity regulator in accordance with the present invention.

To reduce the displacement of the compressor, the supply voltage is applied to the coil 17. The lines of force in the resulting magnetic field are directed as shown by the dotted lines in FIG. 2. The magnetic field intersects the cylinder block 1, the bodies 18 and 19 of the pressure valves 6 and 8, and the cover 2 of the cylinder block 1, and forms a closed circuit completed through the ring disks 9 and 10 of the suction valves 5 and 7.

The resulting magnetizing force lifts the disks 9 and 10 against the force produced by the retracting springs 11 and 12, and the disks 9 and 10 are placed to the open position by force. Now the gas contained in the working spaces of both cylinders 3 and 4 is discharged into the suction chamber 15 of the compressor through the admission ports 13 and 14, hence, the compressor displacement is decreased.

After the supply voltage is cut off the winding of the coil 17, the magnetizing force drops to zero, and the compressor displacement rises to the rated value.

What is claimed is:

1. A piston compressor comprising: a compressor cylinder block including at least two cylinders; a cover on said cylinder block; suction valves mounted inside each of said cylinders; pressure valves located inside each of said cylinders; a regulator for controlling the capacity of said piston compressor; an electromagnet coil on said regulator for actuating said suction valves and being installed on the outer side of said cover; a gasket of nonmagnetic material laid between said cylinder block cover and said cylinder block body; a magnetic circuit connecting said electromagnet coil to each of said suction valves; said magnetic circuit being formed by said cylinder block cover, said cylinder block body and said pressure valves of each said cylinders.

* * * * *